United States Patent [19]

Haynes

[11] 4,234,046

[45] Nov. 18, 1980

[54] PRESSURE DIFFERENTIAL SEAFLOOR CORER-CARRIER

[76] Inventor: Harvey H. Haynes, 690 Mesa Dr., Camarillo, Calif. 93010

[21] Appl. No.: 34,220

[22] Filed: Apr. 30, 1979

[51] Int. Cl.[3] ..... E21B 7/12

[52] U.S. Cl. ..... 175/6; 175/58

[58] Field of Search ..... 175/5, 6, 8, 9, 58, 175/59, 60, 94, 381, 213, 217, 218; 114/295, 296; 405/224, 225; 173/91

[56] References Cited

U.S. PATENT DOCUMENTS

| | | | |
|---|---|---|---|
| 2,678,203 | 5/1954 | Huff | 175/213 |
| 3,306,110 | 2/1967 | Woods | 175/58 X |
| 3,438,452 | 4/1969 | Bernard et al. | 175/6 |
| 3,496,900 | 2/1970 | Mott et al. | 114/296 |
| 3,585,738 | 6/1971 | De Koning | 175/6 X |
| 3,603,408 | 9/1971 | Smulders | 175/6 |
| 3,701,387 | 10/1972 | Koot | 175/6 |
| 3,741,920 | 6/1973 | Hilfing | 175/85 X |
| 3,928,982 | 10/1975 | Lacroix | 405/224 |
| 4,036,161 | 7/1977 | Nixon | 114/296 |
| 4,043,407 | 8/1977 | Wilkins | 175/58 X |

FOREIGN PATENT DOCUMENTS

| | | | |
|---|---|---|---|
| 656837 | 2/1938 | Fed. Rep. of Germany | 175/217 |

*Primary Examiner*—James A. Leppink
*Assistant Examiner*—Richard E. Favreau
*Attorney, Agent, or Firm*—Richard S. Sciascia; Joseph M. St. Amand

[57] ABSTRACT

A pressure differential seafloor corer-carrier for obtaining long core samples of seafloor sediments. The corer-carrier is composed of two main components: The first component is a pump assembly that pumps seawater and sediment as to create a negative pressure differential; the negative pressure differential being the driving force that forces the corers into the seafloor such that cores of over 100 feet in length can be obtained. The second component is a space frame mounted and fastened to the pump and functions as a rack to which conventional corers are attached. Once the corers are embedded to their full length, the pump is used to create a positive pressure differential which helps remove the corer-carrier from the seafloor.

14 Claims, 2 Drawing Figures

PRESSURE DIFFERENTIAL SEAFLOOR CORER-CARRIER

CROSS REFERENCE TO RELATED APPLICATIONS

This application is related to copending U.S. Pat. Application Ser. No. 34,221 for A System for Placement of Piles into the Seafloor by Harvey H. Haynes, filed together herewith on Apr., 30, 1979, and commonly assigned.

BACKGROUND

The purpose of the pressure differential corer-carrier is to obtain long, high-quality sediment samples. To effectively design foundations for seafloor installations and anchors for massive floating structures, it is necessary to obtain certain engineering parameters of the sediments. The need for core samples at sub-bottom depths of 100 feet (30 meters) and greater has become apparent with present day ocean engineering tasks. Conventional coring techniques are not applicable to sub-bottom depths in this range. The device of this invention provides an efficient and economical means for obtaining long, high-quality cores. Novel features of this device also demonstrates principles applicable to other devices for penetrating seafloor sediment, such as piles, embeddment anchors, sediment "motors" and the like.

Various approaches have been tried to obtain long cores. These methods are either too costly or inefficient in obtaining quality cores. Drill ships which use drilling techniques to obtain quality seafloor samples from very deep sub-bottom depths are very expensive.

Another device, a seafloor, bottom-resting platform for obtaining high quality cores, samples the seafloor to a depth of 50 feet (15 meters) by using ten separate 5-foot (1.5 meter) cores taken through a cased drill hole; the hardware is complicated and expensive, and has not found application in the field.

The conventional approach of a gravity corer which uses the downward momentum of a large mass to embed the corer deep into the seafloor has been tried with only limited success for very long cores. The large mass (tens of thousands of pounds) and the corer, which is embedded in the seafloor, is difficult to retrieve without a high capacity winch on-board a surface vessel; this technique is also quite unreliable in obtaining a core of sufficient length.

The use of pressure differential techniques to drive corers themselves or to carry corers into the seafloor have been developed by others. A "bootstrap corer" was developed by Scripps Institution of Oceanography and uses a piston inside the corer to create the pressure differential. After the corer is initially set in the seafloor, the piston is pulled upward inside the corer by a cable from the surface vessel. A negative pressure differential is created on the underside of the piston and drives the corer barrel downward into the seafloor. At the same time, the sediment flows upward into the corer. However, because the sediment flows upward into the corer, it becomes considerably disturbed and is considered a poor quality sediment sample.

The "bootstrap corer" can be used as a corer-carrier where conventional corer barrels are attached to the outside of the bootstrap corer. In this manner, high quality cores can be obtained but the length of the cores are limited. Core length is dependent on the strength of the cable attaching the piston to the surface vessel and upper limit on cable strength dictates that the bootstrap corer have only a relatively small diameter compared to that attainable with the present invention. A small diameter "driver" means a relatively shallow driving depth into the seafloor.

U.S. Pat. Nos. 3,380,256 and 3,805,534 disclose methods to sink caissons and piles into the seafloor by pressure differential. These caissons and piles could function as corer-carriers. However, these prior-art patents have one major limitation. They are all essentially closed top piles. Seawater is removed from the interior to create the pressure differential. Friction forces on both the inside and outside of the pile will counter the driving force. To obtain a depth of 100 feet (30 meters) into the sediment, a large diameter pile is required (on the order of 30 feet (10 meters)) to overcome the friction forces.

This invention overcomes the above limitations.

DESCRIPTION OF THE PREFERRED EMBODIMENT

Figure 1:
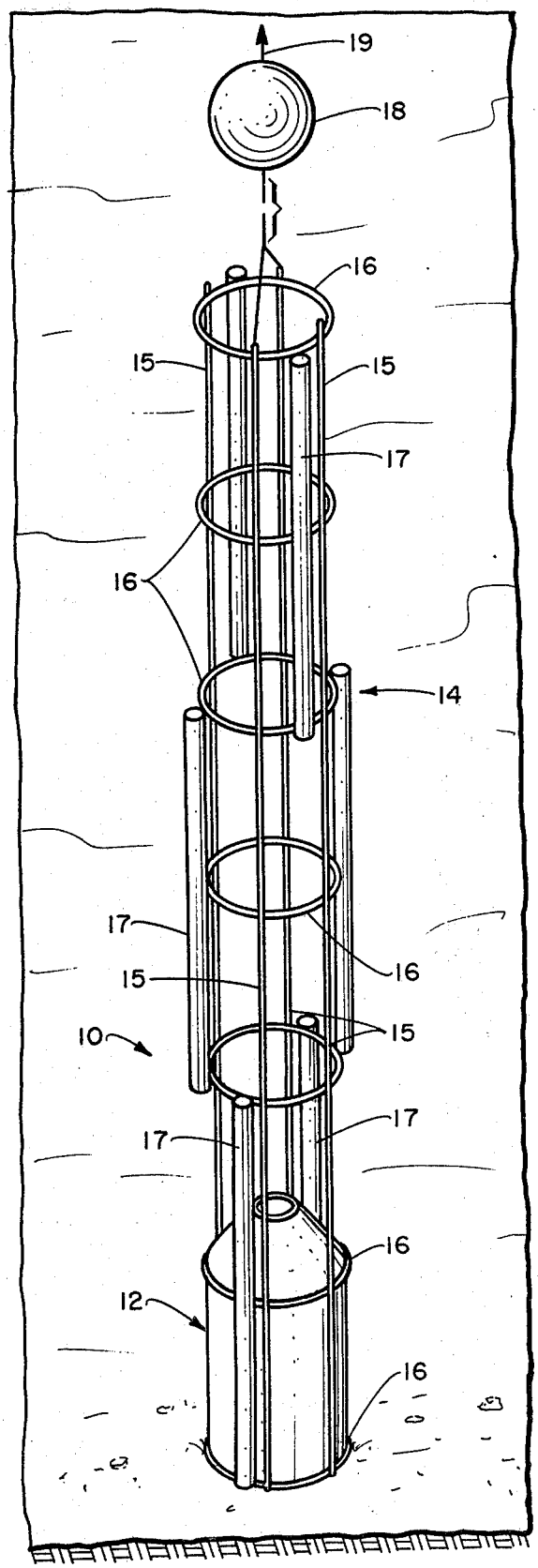
FIG. 1 is an illustration of a preferred embodiment of the invention shown in the environment where used.

Referring to FIG. 1, a pump unit 12 is shown mounted at the leading end of the corer-carrier 10. Space frame 14 is mounted on top of the pump unit 12 and attached thereto. Space frame 14 is comprised of straight rods 15 and hoops 16 to which conventional corers 17 are attached. Conventional corers basically consist of a cylindrical core barrel having a leading knife-edge and a core catcher to prevent the core of sediment from slipping out during retrieval. As shown in FIG. 1, two corers 17 are located diametrically opposite each other at each of several elevations. A sub-surface buoy 18 is attached to the upper end of space frame 14 of the corer-carrier. The purpose of buoy 18 is to aid corer-carrier 10 in remaining straight as it is driven down into the seafloor sediment, i.e., the buoy imparts a righting-moment when the corer-carrier tilts. Cable 19 is connected to a winch or the like on a surface vessel and functions as a lowering and lift line, and also as the electrical and/or hydraulic link to the surface.

Figure 2:
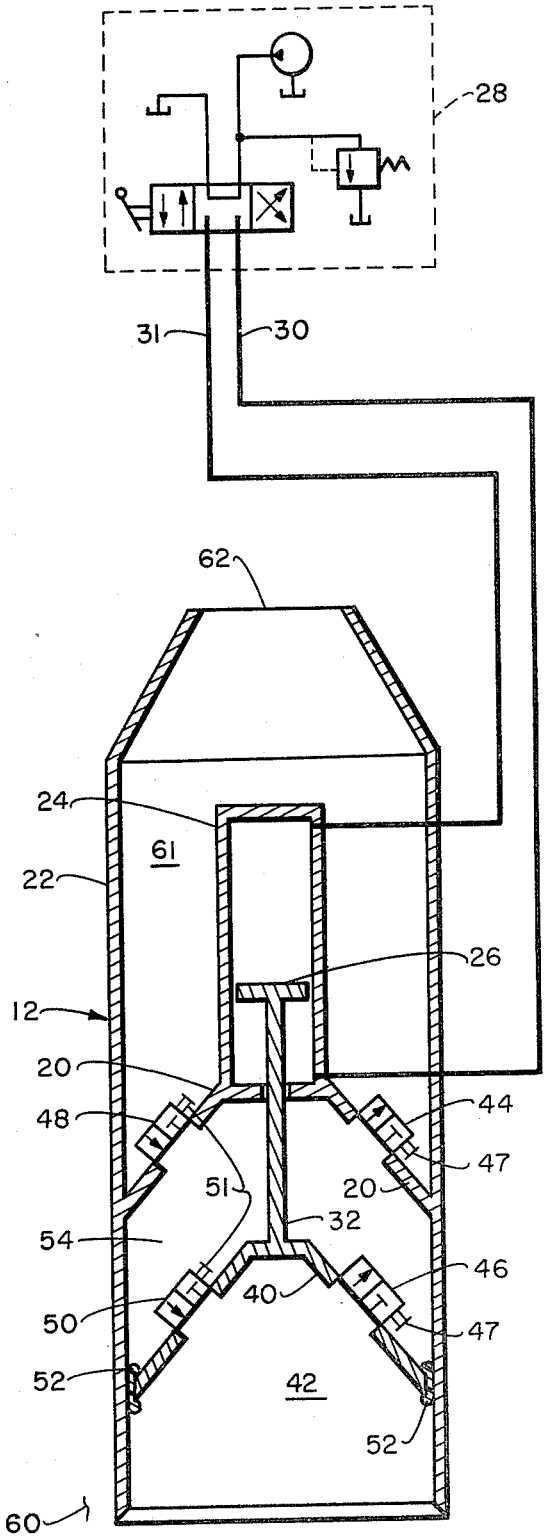
FIG. 2 shows a schematic diagram of the pump unit of FIG. 1 and hydraulic power system.

Referring to FIG. 2, details of the pump unit 12 are shown. Bulkhead 20 is a watertight and pressure-resistant shell which spans the cylindrical housing 22. Attached to bulkhead 20 is a hydraulic cylinder 24 which contains piston 26. Piston 26 moves in a reciprocating manner by means of a hydraulic system 28 connected thereto by means of hydraulic lines 30 and 31. This reciprocating movement is transferred by ram 32 to a large piston 40 so that water and sediment are pumped from cavity 42. Check valves 44 and 46 only are set to function, by means of solenoids 47, for example, when the corer-carrier moves forward (downward) into the sediment. When the corer-carrier moves back out of the sediment, only check valves 48 and 50 are set to function, by means of solenoids 51, for example. Seal 52 isolates cavity 54 from cavity 42. Check valves 44 and 46 are unable to function, i.e., are locked closed, when check valves 48 and 50 are functioning, and check valves 48 and 50 are unable to function, i.e., are locked closed, when check valves 44 and 46 are set to function. Solenoids 47 and 51, for locking or unlocking the check valves, can be remotely operated from the surface via cables (not shown), or connected to controls housed within hydraulic system 28, if desired.

Pump unit 12 functions in the following manner: when ram 32 is fully extended and just starts on an up-stroke, a lower pressure is created on the bottom side of the piston 40. Hence, a pressure differential exists between the ambient environment 60 and the cavity 42. This pressure differential is the source of the driving force which pushes the corer-carrier into the sediment.

During the upstroke, water and sediment in cavity 54 are squeezed through check valve 44 into cavity 61 where excess water and sediment exit through the top at opening 62. At the top of the stroke, the direction of ram 32 is changed. Water and sediment now flow through check valve 46 until another upstroke starts.

The driving force acting across the top of bulkhead 20 is equal to the pressure differential times the cross-sectional area of piston 40. There also exists a "driving" force across the bottom which tries to push sediment into cavity 42. The sediment will not be pushed in if the pressure differential is less than the bearing strength of the sediment. However, if the pressure differential is greater than the bearing strength of the sediment, then sediment will flow into cavity 42.

Tests have shown that the corer-carrier 10 can move down while simultaneously the sediment flows upward. The corer-carrier ceases to move down when the skin friction forces equal the driving force.

Consider an example of the corer-carrier moving downward by action of pump unit 12. A 6-foot (1.8 meter) diameter piston 40, for example, which is operating in a weak clay or silty clay sediment having a typical shearing strength of 6 psi (42 kPa) at 100 feet (30 meter) depth, can develop a driving force of about 220,000 lbs (100 mg). If corer-carrier 10 is operating in a strong clayey silt or silt sediment having a typical shearing strength of 18 psi (124 kPa) at 100 feet (30 meter) depth, then a driving force of about 660,000 lbs (300 mg) can be developed. For each sediment condition, the driving force is sufficient to overcome skin friction down to 100 feet (30 meters). This is accomplished without exceeding the bearing strength of the soil.

To remove corer-carrier 10 from the sediment, the pump unit 12 needs to create a higher pressure than ambient on the bottom side of piston 40. To accomplish this, check valves 44 and 46 are locked in a closed position and check valves 48 and 50 are unlocked. Check valves 48 and 50 operate in the reverse direction to that of check valves 44 and 56. Hence, on a down stroke of ram 32, a higher than ambient pressure will be created in cavity 42. This positive pressure differential tends to "jack" the corer-carrier 10 out of the seafloor, but this action is not as efficient as desired in actually removing the corer-carrier from the sediment. The sediment that gets pumped into cavity 42 is liquified or remolded and has a low shearing strength. The real benefit gained by operating the pump is this reverse direction is to overcome the breakout forces (or "suction effect") as the corer-carrier is removed from the sediment by the surface vessel tensioning cable 19.

Opening 62 at the top of the pump housing is smaller (i.e. tapered) in diameter than cylinder housing 22 so that during removal from the seafloor, the corer-carrier will tend to follow the same path going out of the seafloor that it made while going into the seafloor. Conventional corers 17 are mounted outboard of the diameter of pump unit 12, as shown in FIG. 1. They move through undisturbed sediment and obtain high quality sediment samples. At any cross-section of corer-carrier 10 two or more conventional corers 17 should be mounted in a symmetrical pattern. This balanced-load condition assists the corer-carrier going straight into the seafloor. However, even if the corer-carrier penetrates the seafloor sediment in a tilted position, one of the conventional corers 17 along the whole length will sample undisturbed sediment.

The invention provides a novel means for creating a pressure differential to drive objects into and under the seafloor. This corer-carrier device pumps water and sediment from one side of bulkhead 40 to the other side in such a manner as to create a pressure-differential. The device can drive objects, and even operate itself, while under the seafloor.

By locating pump unit 12 at the leading end of the corer-carrier, another advantage is gained. The weight of soil above pump unit 12 is effective in acting as part of the external pressure head. In prior art methods, only the water weight above a corer-carrier or pile was effective in being the external pressure head. Thus, this invention in certain shallow water applications can be driven deeper into the seafloor because a greater external pressure head is available at the pump unit.

A corer-carrier, as described herein, of about 6 feet (1.8 meter) diameter, for example, will permit conventional corers to be driven to 100 feet (30 meter) depths and obtain high quality sediment samples. Greater depths are obtainable by properly sizing the diameter of the corer-carrier.

Obviously, many modifications and variations of the present invention are possible in light of the above teachings. It is, therefore, to be understood that within the scope of the appended claims the invention may be practiced otherwise than as specifically described.

What is claimed is:

1. A pressure differential seafloor corer-carrier for obtaining long core samples of seafloor sediments, comprising:

a. a space frame having a longitudinal axis;

b. a plurality of soil corers mounted lengthwise along the longitudinal axis of said space frame;

c. a pressure-differential pump unit connected to said space frame for driving said space frame and corers into the seafloor in a general direction along the longitudinal axis of said space frame;

d. said pump unit including means for pumping water and sediment from the seafloor through the pump unit to force said space frame and said soil corers into the seafloor;

e. said pump unit also including means for reversing the flow of water and sediment therethrough for backing said pump unit out of the seafloor together with said space frame and said soil corers.

2. A device as in claim 1 wherein said pressure-differential pump unit is mounted on the leading end of said space frame.

3. A device as in claim 1 wherein means is provided for raising and lowering said corer-carrier to the seafloor from a surface vessel and to impart a righting-moment should the corer-carrier tilt, said means for raising and lowering the corer-carrier including electrical and hydraulic links to said surface vessel.

4. A device as in claim 1 wherein an underwater buoy is attached to the upper end of said space frame to aid said corer-carrier in remaining vertically straight at it is driven into the seafloor.

5. A device as in claim 1 wherein said plurality of soil corers are mounted on the exterior surface of said space frame.

6. A device as in claim 1 wherein said corers are mounted outboard of the diameter of said space frame and pump unit in order that they will move through undisturbed sediment for obtaining high quality sediment core samples.

7. A device as in claim 6 wherein said corers are mounted in a symmetrical pattern about said space frame to provide a balanced-load condition which assists the corer-carrier in going into the seafloor straight.

8. A device as in claim 1 wherein said pump unit comprises:

a. a cylindrical pump housing open at either end thereof; one end being the leading edge of said pump housing and the other end being the expulsion end thereof;

b. a watertight, pressure-resistant bulkhead spanning the interior walls of said housing at a position intermediate the open ends thereof and separating the interior of said housing into upper and lower housing chambers;

c. an hydraulic cylinder containing a first piston means mounted centrally to said bulkhead; said first piston means operable to be moved in a reciprocating manner;

d. an hydraulic power system connected to said hydraulic cylinder for operating said first piston means in said reciprocating manner;

e. a second piston means movably mounted between said bulkhead and the leading edge of said cylindrical pump housing;

f. a ram-rod means slideably passing through one end of said hydraulic cylinder and connecting said first piston means to said second piston means to impart movement from said first piston means to said second piston means;

g. a first set of check valves, at least one in said bulkhead and at least one in said second piston means, respectively, operable to allow water and sediment to pass therethrough from said lower housing chamber to said upper housing chamber only when said corer-carrier is to be moved downward into the seafloor; and, a second set of check valves, at least one in said bulkhead and at least one in said second piston means, respectively, operable to allow water and sediment to pass therethrough from said upper housing chamber to said lower housing chamber only when said corer-carrier is to be moved back out of the seafloor;

h. operation of said first and second piston means by means of said hydraulic power system with only said first set of check valves functioning so as to allow water and sediment to pass upward through said pump unit causing said corer-carrier to move downward into the seafloor, and operation of said pump pistons with only said second set of check valves functioning so as to allow water and sediment to pass downward through the pump unit causing said corer-carrier to backup out of the seafloor.

9. A device as in claim 8 wherein said hydraulic power system is located remote from said corer-carrier.

10. A device as in claim 8 wherein the expulsion end of said cylindrical housing is tapered to a smaller diameter so that during backing out from beneath the seafloor the corer-carrier will tend to follow the same path as in entering the seafloor.

11. A device as in claim 8 wherein lock means are connected to each of said first set and said second set of check valves, respectively, for permitting said check valves either to operate in a functioning mode where water and sediment are allowed to pass through the respective valves in one direction only or to be locked in a non-functioning mode where nothing is allowed to pass therethrough in either direction.

12. A device as in claim 11 wherein said lock means are operated by solenoids that can be remotely actuated from another location.

13. A device as in claim 8 wherein said pressure-differential pump unit is located on the leading end of said space frame.

14. A device as in claim 13 wherein operation of said first and second hydraulic piston means creates a pressure differential which in turn forces said corer-carrier into the sediment and soil of the seafloor, and the weight of sediment and soil above the pump unit as it moves beneath the seafloor acts to enhance the external pressure head to help drive the corer-carrier deeper into the seafloor.

* * * * *